US008129321B2

(12) United States Patent
Lee et al.

(10) Patent No.: US 8,129,321 B2
(45) Date of Patent: Mar. 6, 2012

(54) LIQUID COMPOSTION FOR CLEANING A NOZZLE SURFACE, METHOD OF CLEANING A NOZZLE SURFACE USING THE LIQUID COMPOSITION, AND INKJET RECORDING APPARATUS INCLUDING THE LIQUID COMPOSITION

(75) Inventors: Ho-Ryul Lee, Suwon-si (KR); Heung-Sup Park, Suwon-Si (KR); Sung-Woon Kang, Suwon-Si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 116 days.

(21) Appl. No.: 12/543,140

(22) Filed: Aug. 18, 2009

(65) Prior Publication Data

US 2010/0091066 A1 Apr. 15, 2010

(30) Foreign Application Priority Data

Oct. 14, 2008 (KR) ..... 10-2008-0100765

(51) Int. Cl.
*C11D 1/72* (2006.01)
*C11D 3/20* (2006.01)
*C11D 3/43* (2006.01)

(52) U.S. Cl. ..... 510/170; 510/413; 510/421; 510/475; 510/499; 510/505

(58) Field of Classification Search ..... 510/170, 510/413, 421, 475, 499, 505
See application file for complete search history.

(56) References Cited

U.S. PATENT DOCUMENTS 4,753,970 A * 6/1988 Saito et al. ..... 524/101
6,121,228 A * 9/2000 Drapier et al. ..... 510/417
2011/0056517 A1* 3/2011 Motsenbocker ..... 134/6

* cited by examiner

*Primary Examiner* — Brian P Mruk
(74) *Attorney, Agent, or Firm* — Stanzione & Kim, LLP

(57) ABSTRACT

Provided are a liquid composition for cleaning a nozzle surface of an inkjet printer, a method of cleaning a nozzle surface using the liquid composition and an inkjet recording apparatus including the liquid composition. The liquid composition includes a polyoxyethyleneglycol-based compound and may include a stabilizer.

15 Claims, 4 Drawing Sheets

LIQUID COMPOSTION FOR CLEANING A NOZZLE SURFACE, METHOD OF CLEANING A NOZZLE SURFACE USING THE LIQUID COMPOSITION, AND INKJET RECORDING APPARATUS INCLUDING THE LIQUID COMPOSITION

CROSS-REFERENCE TO RELATED PATENT APPLICATION

This application claims the benefit of Korean Patent Application No. 10-2008-0100765, filed on Oct. 14, 2008 in the Korean Intellectual Property Office, the disclosure of which is incorporated by reference herein in its entirety.

TECHNICAL FIELD

This disclosure relates to ink printing. In particular, it is a liquid composition for cleaning a nozzle surface of a printer, a method of cleaning the nozzle surface using the liquid composition and an inkjet recording apparatus including the liquid composition.

BACKGROUND

A variety of methods for producing colorizing images have been developed. Such methods include a dye-sublimation printing method, a thermal wax transfer printing method, an inkjet printing method, an electrophotographic printing method, and a thermally processed silver printing method.

Inkjet printers are used in a wide range of applications, including the advertising and broadcasting industries. It is desirable to improve printing quality and reduce the manufacturing costs of inkjet printers.

In the inkjet printing method, ink droplets are ejected from a nozzle of a printing head onto a printing medium, such as a paper sheet, thereby forming dots, which together form letters or images. The inkjet printing method is usually less expensive than other printing methods and high-quality color images can be printed. Ink used in the inkjet printing method may be prepared by dissolving or dispersing water-soluble dye or pigment in a solvent including water and a water-soluble organic solvent. The ink may further include a surfactant.

Inkjet printers may be piezoelectric-type inkjet printers, which eject ink using a piezoelectric device or thermal-type inkjet printers, which eject ink using a thermal device.

In thermal-type printers, the ink contained in an ink chamber of an inkjet printer head is evaporated by a heating device to generate bubbles. Ink droplets in the ink chamber are ejected onto a printing medium through an orifice, such as a nozzle. Therefore, a thermal-type inkjet printer includes an inkjet printer head, a heating device, which heats ink and may be positioned in the ink chamber. The printer also may have an operating circuit, such as a logic integrated circuit, operating the heating device.

Research into ink is being conducted to improve the throughput of inkjet printers and the clarity and brightness of images. For example, a pigment ink may increase the printing speed, improve color clarity and improve waterfastness of black ink. Pigment ink and dye ink should dry quickly on a paper medium. However, quick drying may clog an inkjet printer head. Clogging can be caused by ink, dust or paper. For a pigment ink in which pigment is dispersed in a water solvent, phase separation may occur in a drying process, thereby forming solid clumps. Such solid clumps formed on a nozzle surface cannot be easily removed and may affect the quality of printed images. When nozzle clogging or nozzle wetting occurs, ink ejection is hindered. The ejection speed of ink is also decreased and it becomes more difficult for ink droplets to be ejected.

Conventional methods of removing impurities from a nozzle surface are not effective for removing impurities remaining on the nozzle surface.

SUMMARY

We provide a liquid composition for cleaning a nozzle surface. The composition comprises a solvent and a polyoxyethyleneglycol-based compound. The amount of the polyoxyethyleneglycol-based compound may be about 0.1 to about 20 parts by weight based on 100 parts by weight of the solvent.

We also provide a method of cleaning the surface of at least one nozzle. The method comprises providing a liquid composition for cleaning a nozzle surface. The composition comprises a solvent and a polyoxyethyleneglycol-based compound. The amount of the polyoxyethyleneglycol-based compound may be about 0.1 to about 20 parts by weight based on 100 parts by weight of the solvent. The liquid composition is applied to the surface of at least one nozzle. The nozzle surface may then be wiped with a blade or a flexible bag.

We also provide an inkjet recording apparatus comprising at least one cartridge comprising a cleaning unit. The cleaning unit comprises a liquid composition for cleaning a nozzle surface. The composition comprises a solvent and a polyoxyethyleneglycol-based compound. The amount of the polyoxyethyleneglycol-based compound may be about 0.1 to about 20 parts by weight based on 100 parts by weight of the solvent. The recording apparatus may also comprise at least one inkjet head comprising at least one nozzle having at least one outlet hole for dispensing ink.

BRIEF DESCRIPTION OF THE DRAWINGS

The above and other features and advantages will become more apparent by describing in detail representative examples with reference to the attached drawings in which.

DETAILED DESCRIPTION

Figure 1:
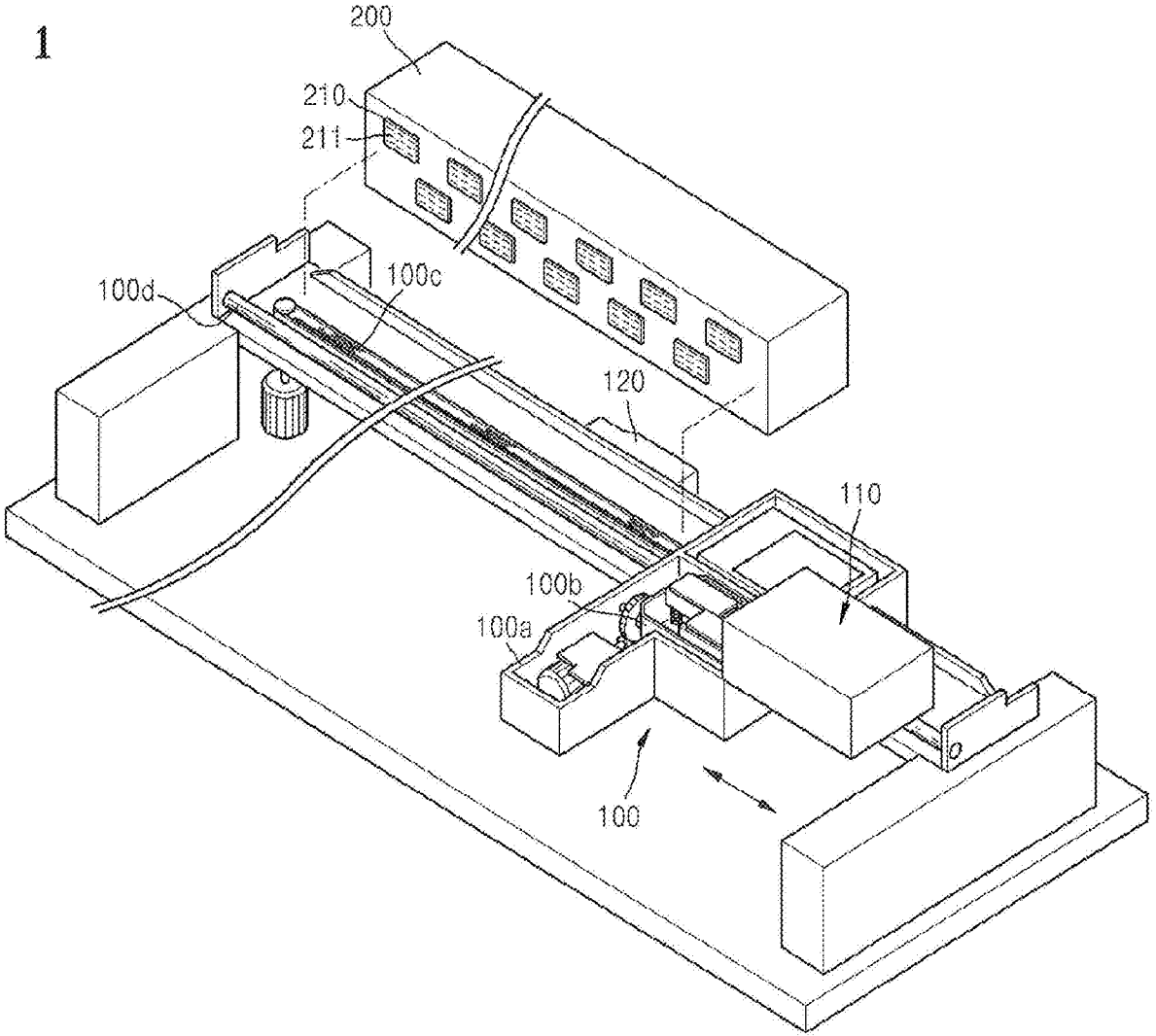
FIG. 1 is a perspective view of an inkjet printer including a nozzle cleaning device.

The disclosure will now be described more fully with reference to the accompanying drawings in which representative examples are shown.

In one aspect, the disclosure provides a liquid composition for cleaning a surface such as the surface of a nozzle. The liquid composition effectively removes impurities formed on the nozzle surface that may result from printing. Cleaner surfaces means ink droplets can be more stably ejected from a printer head for a longer period of time. This gives the printer head a longer life and keeps maintenance costs low. The liquid composition may be sprayed or coated on the nozzle surface. Impurities on the nozzle surface may then be removed with a blade.

The liquid composition includes a solvent and a polyoxyethyleneglycol-based compound. The polyoxyethyleneglycol-based compound may be represented by Formula 1:

<Formula 1>

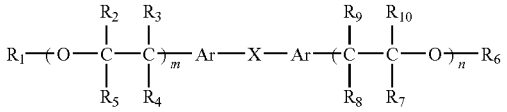

X may be a connecting group, O, S, C═O, or a substituted or unsubstituted C1-C20 alkylene group. Ar may be a C6-C30 substituted or unsubstituted arylene group, or a C2-C30 substituted or unsubstituted heteroarylene group. $R_1$, $R_2$, $R_3$, $R_4$, $R_5$, $R_6$, $R_7$, $R_8$, $R_9$ and $R_{10}$ may each independently be hydrogen, halogen, a carboxylic group, a cyano group, an amino group, a substituted or unsubstituted C1-C20 alkyl group, a substituted or unsubstituted C1-20 alkoxy group, a substituted or unsubstituted C2-20 alkenyl group, a substituted or unsubstituted C2-20 alkynyl group, a substituted or unsubstituted C1-20 heteroalkyl group, a substituted or unsubstituted C6-C30 aryl group, or a substituted or unsubstituted C4-30 heteroaryl group. And, m and n may independently be an integer in the range of 1 to 10.

The polyoxyethyleneglycol-based compound may have a hydrophilic group and a hydrophobic group. The hydrophobic group has an aryl-based moiety, which, structurally, has an affinity with an aryl structure of pigment or dye. Thus, the hydrophilic group may dissolve impurities on the nozzle surface with water. Accordingly, when the polyoxyethyleneglycol-based compound is used, the impurities can be more efficiently removed.

The polyoxyethyleneglycol-based compound may also be represented by Formula 2:

<Formula 2>

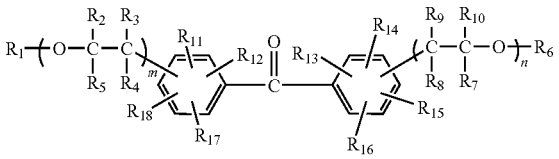

$R_1$, $R_2$, $R_3$, $R_4$, $R_5$, $R_6$, $R_7$, $R_8$, $R_9$, $R_{10}$, $R_{11}$, $R_{12}$, $R_{13}$, $R_{14}$, $R_{15}$, $R_{16}$, $R_{17}$ and $R_{18}$ may each independently be hydrogen, halogen, a carboxylic group, a cyano group, an amino group, a substituted or unsubstituted C1-C20 alkyl group, a substituted or unsubstituted C1-20 alkoxy group, a substituted or unsubstituted C2-20 alkenyl group, a substituted or unsubstituted C2-20 alkynyl group, a substituted or unsubstituted C1-20 heteroalkyl group, a substituted or unsubstituted C6-C30 aryl group, or a substituted or unsubstituted C4-30 heteroaryl group. And, m and n may each independently be an integer in the range of 1 to 10.

The polyoxyethyleneglycol-based compound may also be represented by Formula 3 or 4:

<Formula 3>

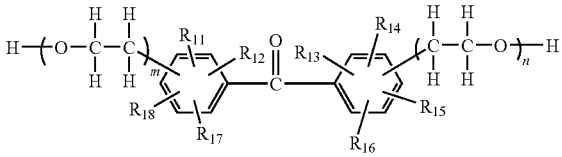

-continued

<Formula 4>

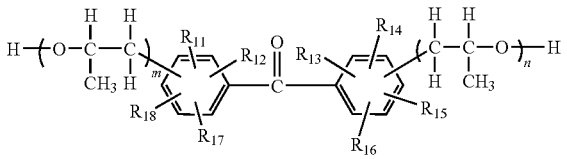

$R_{11}$, $R_{12}$, $R_{13}$, $R_{14}$, $R_{15}$, $R_{16}$, $R_{17}$ and $R_{18}$ may be the same as previously described and m and n are each independently an integer in the range of 1 to 10.

The polyoxyethyleneglycol-based compound may also be any one compound selected from compounds represented by Formulas 5 through 7, but is not limited thereto:

<Formula 5>

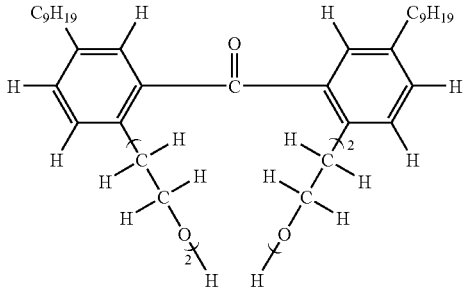

<Formula 6>

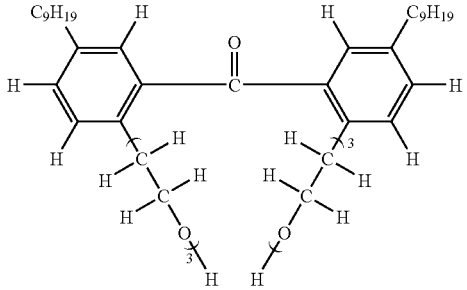

<Formula 7>

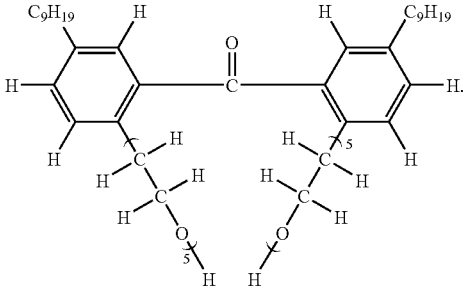

The amount of the polyoxyethyleneglycol-based compound may be about 0.1 to about 20 parts by weight, specifically about 0.3 to about 10 parts by weight, and more specifically about 1 to about 5 parts by weight, based on 100 parts by weight of the solvent.

In this regard, if the amount of the polyoxyethyleneglycol-based compound is less than about 0.1 parts by weight based on 100 parts by weight of the solvent, the ink residual may not be effectively removed. On the other hand, if the amount of the polyoxyethyleneglycol-based compound is greater than about 20 parts by weight based on 100 parts by weight of the solvent, the dissolving capability of the liquid composition may be degraded and the nozzle surface may be damaged.

The viscosity of the liquid composition may be equal to or less than the viscosity of ink used in an inkjet printing process. This is because when the viscosity of the liquid composition is lower than that of ink, the viscosity of the high-concentration ink residue and the viscosity of ink itself can be reduced. This enhances the cleaning capability of the liquid composition. The viscosity of the liquid composition may be in a range of about 1.5 to about 20 cps, for example, about 2 to about 10 cps. If the viscosity of the liquid composition is less than 1.5, it may be difficult to spray the liquid composition on a head chip and the liquid composition may dry too easily. On the other hand, if the viscosity of the liquid composition is greater than 20 cps, the liquid composition may not be completely removed from the surface of a head chip and may permeate into the nozzle, thereby contaminating ink.

The liquid composition may further include a stabilizer. The stabilizer may include at least one compound selected from the group consisting of a cyclic amide-based compound, an ammonium-based compound, an alcohol-based compound, a ketone-based compound, a cyclic carbonate-based compound, and a phthalate-based compound. For example, the stabilizer may include at least one compound selected from the group consisting of 2-pyrrolidone, 1-methyl-2-pyrrolidone, N-(2-hydroxyethyl)-2-pyrrolidone, ammonium hydroxide, diethyleneglycolbutylether, urea, e-caprolactam, ethylene carbonate, benzyl alcohol, cyclohexanone, and dibutylphthalate. However, the stabilizer may also include other compounds.

The amount of the stabilizer may be in a range of about 0.01 to about 20 parts by weight; specifically about 0.1 to about 5 parts by weight, based on 100 parts by weight of the solvent. If the amount of the stabilizer is less than 0.01 parts by weight based on 100 parts by weight of the solvent, the stabilizer may have insignificant stabilizing and cleaning effects. On the other hand, if the amount of the stabilizer is greater than 20 parts by weight based on 100 parts by weight of the solvent, phase separation and precipitation may occur.

The pH of the liquid composition for cleaning a nozzle surface according to the disclosure may be in a predetermined range. For example, the pH of the liquid composition may be in a range of ±2 of the pH of the ink used in the inkjet printing process. Specifically, the pH of the liquid composition may be in a range of about 6 to about 10. If the pH of the liquid composition is less than 6, the ink may precipitate due to a strong acidic condition. On the other hand, if the pH of the liquid composition is greater than 10, the liquid composition may react with the ink.

The solvent may be a water-based solvent, an organic solvent, or a mixture thereof.

The water-based solvent may be water or the like. The organic solvent may include at least one solvent selected from the group consisting of a monovalent alcohol-based solvent, a polyhydric alcohol-based solvent, a ketone-based solvent, an ester-based solvent, a nitrogen-containing solvent, and a sulfur-containing solvent. The monovalent alcohol-based solvent may control the surface tension of ink so as to improve permeability of the ink into a recording medium, such as a general sheet or a sheet designed for specific purposes, a dot forming ability of ink, and a dry characteristic of a printed image. The polyhydric alcohol-based solvent or derivatives thereof may not easily evaporate and reduce the freezing point of ink, and thus, ink becomes more stably preserved, preventing the nozzle from clogging.

The monovalent alcohol-based solvent may be a lower alcohol, such as methyl alcohol, ethyl alcohol, n-propyl alcohol, i-propyl alcohol, n-butyl alcohol, s-butyl alcohol, or t-butyl alcohol, specifically ethyl alcohol, i-propyl alcohol, or n-butyl alcohol. The polyhydric alcohol-based solvent may be selected from: alkyleneglycols, such as ethyleneglycol, diethyleneglycol, triethyleneglycol, propyleneglycol, butyleneglycol, or glycerol; polyalkyleneglycols, such as polyethyleneglycol or polypropyleneglycol; thiodigylcol; low alkyl ethers of the polyhydric alcohol-based solvent described above, such as ethyleneglycoldimethylether; and low carboxylic acid esters of the polyhydric alcohol-based solvent, such as ethyleneglycoldiacetate. The ketone-based solvent may be acetone, methylethylketone, diethylketone, or diacetonealcohol. The ester-based solvent may be methyl acetate, ethyl acetate, or ethyl lactate.

The nitrogen-containing solvent may be 2-pyrrolidone or N-methyl-2-pyrrolidone, and the sulfur-containing solvent may be dimethyl sulfoxide, tetramethylene sulfone, or thioglycol.

The solvent mixture may include the water-based solvent and the organic solvent. In this regard, the amount of the organic solvent may be in a range of about 0.1 to about 130 parts by weight based on 100 parts by weight of the water-based solvent. If the amount of the organic solvent is less than about 0.1 parts by weight based on 100 parts by weight of the water-based solvent, ink may evaporate too quickly and the stability of ink may be degraded. On the other hand, if the amount of the organic solvent is greater than about 130 parts by weight based on 100 parts by weight of the water-based solvent, the viscosity of ink is increased and the ejection performance may be degraded.

The liquid composition may have a surface tension of about 15 to about 73 dyne/cm, specifically about 25 to about 55 dyne/cm, at a temperature of 20° C.

The liquid composition may further include various additives to enhance its characteristics. For example, the liquid composition for cleaning a nozzle surface may include at least one kind of additive selected from the group consisting of a wetting agent, a dispersing agent, a surfactant, a viscosity controller, a pH controller and an antioxidant. The amount of the additive may be in a range of about 0.1 to about 20 parts by weight; specifically about 1 to about 15 parts by weight, based on 100 parts by weight of the solvent.

The substituents used in the compounds according to the disclosure may be defined as follows: An "alkyl group" is a linear or branched saturated monovalent hydrocarbon moiety having 1 to 20 carbons. It may have 1 to 10 carbons or 1 to 6 carbons. In the alkyl group, at least one hydrogen atom may be substituted with a halogen atom, a hydroxyl group, —SH, a nitro group, a cyano group, a substituted or unsubstituted amino group (—$NH_2$, —NH(R), or —N(R')(R") where R' and R" are each independently a C1 to 10 alkyl group), an amidino group, a hydrazine or hydrazone group, a carboxylic group, a sulfonic acid group, a phosphoric acid group, a C1-C20 alkyl group, a C1-C20 halogenated alkyl group, a C1-C20 alkenyl group, a C1-C20 alkynyl group, a C1-C20 heteroalkyl group, a C6-C20 aryl group, a C6-C20 arylalkyl group, a C6-C20 heteroaryl group, or a C6-C20 heteroarylalkyl group.

Examples of the alkyl group include methyl, ethyl, propyl, 2-propyl, n-butyl, iso-butyl, tert-butyl, pentyl, hexyl, dodecyl, fluoromethyl, difluoromethyl, trifluoromethyl, chroromethyl, dichroromethyl, trichroromethyl, iodinemethyl, and boromomethyl.

An "alkoxy group" is an oxygen-containing linear or branched alkoxy group having a C1-C20 alkyl moiety. For example, the alkoxy group may be a C1-C6 alkoxy group, or a C1-C3 alkoxy group. Examples of the alkoxy group include methoxy, ethoxy, propoxy, butoxy and t-butoxy. The alkoxy group may be substituted with at least one halo atom selected from fluoro, chloro, and bromo, thereby forming a haloalkoxy group. Examples of the haloalkoxy group include fluoromethoxy, chroromethoxy, trifluoromethoxy, trifluoroethoxy, fluoroethoxy, and fluoropropoxy. In the alkoxy group, at least one hydrogen atom may be substituted with the same substituents as those used for the alkyl group.

An "aryl group" is a monovalent monocyclic, bicyclic, or tricyclic aromatic hydrocarbon moiety having 6 to 30 ring atoms. It may have 6 to 18 ring atoms and may be substituted with at least one hydrogen substituent. The aromatic moiety of the aryl group preferably has only carbon atoms. Examples of the aryl group include phenyl, naphthalenyl, and fluorenyl. In the aryl group, at least one hydrogen atom may be substituted with the same substituents as those used for the alkyl group.

A "heteroalkyl group" or "heteroaryl group" is a functional group that is formed by substituting some of a plurality of ring-forming carbon atoms of the alkyl or aryl group described above with a hetero atom, such as a nitrogen atom, a sulfur atom, a phosphorous atom, or an oxygen atom.

An "alkylene group" is a linear or branched saturated bivalent hydrocarbon moiety having, 1 to 20 carbons. It may have 1 to 10 carbons or more specifically, possibly 1 to 6 carbons. In the alkylene group, at least one hydrogen atom may be substituted with the same substituents as those used for the alkyl group. Examples of the alkylene group include methylene, ethylene, propylene, and n-butylene.

An "arylene group" is a monovalent monocyclic, bicyclic, or tricyclic aromatic hydrocarbon moiety having 6 to 30 ring atoms, specifically 6 to 18 ring atoms. In the arylene group, at least one hydrogen atom may be substituted with the same substituents as those used for the alkyl group.

A "heteroarylene group" is a functional group that is formed by substituting some of a plurality of ring-forming carbon atoms of the arylene group with a hetero atom, such as a nitrogen atom, a sulfur atom, a phosphorous atom, or an oxygen atom. In the heteroarylene group, at least one hydrogen atom may be substituted with the same substituents as those used for the alkyl group.

Also provided is a method of cleaning a nozzle surface. This includes: applying the liquid composition described above to the nozzle surface in order to clean the nozzle surface and wiping the nozzle surface with a blade or a flexible bag.

The liquid composition for cleaning the nozzle surface may be applied to the nozzle surface by ink-jetting using a dummy nozzle or by spraying. The liquid composition for cleaning the nozzle may be sprayed by, for example, an oscillator (ultrasonic device). Then, the nozzle surface to which the liquid composition is applied may be directly wiped by a blade or a flexible bag including a fluid sealed therein. Alternatively, after the nozzle surface is wiped with the flexible bag, the flexible bag may be wiped with the blade.

Where the liquid composition is applied to the nozzle surface by ink-jetting or spraying, the liquid composition may also be applied to either or both the blade and the flexible bag.

At least one kind of the liquid composition may constitute an inkjet cleaning unit. The inkjet cleaning unit may be placed in a liquid composition container of an inkjet recording apparatus or a separate inkjet printer cartridge.

An inkjet recording apparatus may include a thermal-type head in which ink droplets are elected due to vapor pressure generated when an ink composition is heated. It may also include a piezo-type head in which ink droplets are ejected by a piezo device. Other heads include a disposable-type head, or a permanent-type head. The inkjet recording apparatus may be a scanning-type printer or an array-type printer. If it is an array-type printer, it may have at least 10,000 nozzles, possibly, from about 20,000 to about 60,000 nozzles. The inkjet recording apparatus is suited for office work, the textile industry or other industries.

The head types, printer types and other applications described in regard to the inkjet recording apparatus are just examples for describing an inkjet recording apparatus. An inkjet recording apparatus using the liquid composition described above, is not limited to the above-described inkjet recording apparatuses.

Figure 2:
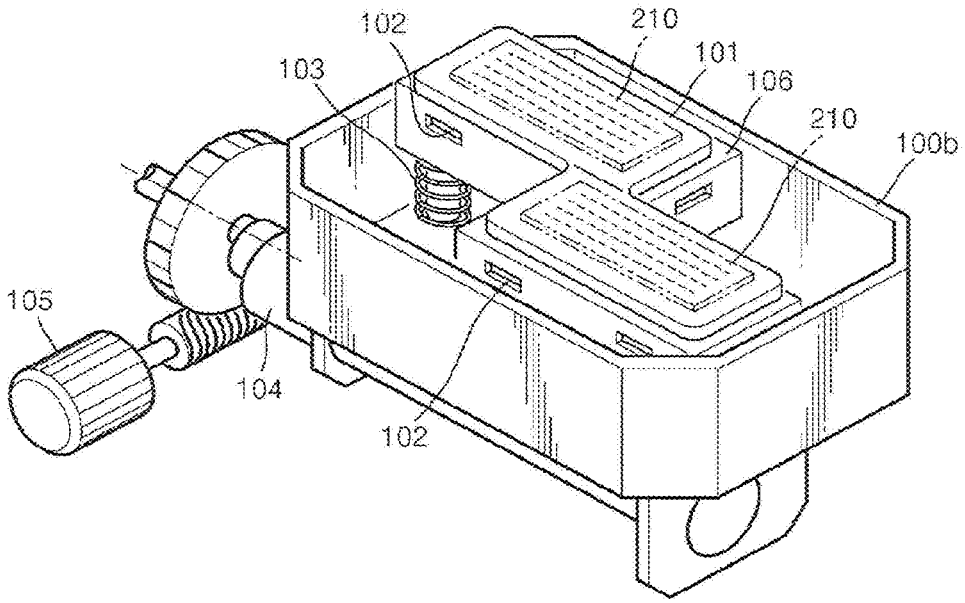
FIG. 2 is a perspective view of a portion of the nozzle cleaning device of FIG. 1.

FIG. 1 is a perspective view of an inkjet recording apparatus including a nozzle cleaning device 100 an embodiment of the liquid composition described above. FIG. 2 is an enlarged view of a portion of the inkjet recording apparatus of FIG. 1.

Referring to FIG. 1, the inkjet recording apparatus includes an inkjet head 200. FIG. 1 shows an array-type inkjet head, however, other types may be used. FIG. 1 also shows a plurality of nozzles 210 aligned in a width direction of a printing medium (not shown).

The nozzle cleaning device 100 cleans the nozzles 210 of the inkjet head 200, as described below. The liquid composition may be agitated by an oscillator. This may bring the liquid composition directly in contact with a surface of the nozzles 210. Then, the liquid composition on the surface of the nozzles 210 may be removed by a blade (not shown). Alternatively, a flexible bag 101 containing a fluid can be used to wipe the surface of the nozzles 210 to clean the outlet holes 211.

An outer housing 100*a* reciprocates along a guide rail 100*d* when a rotary belt 100*c* is operated. As shown in FIG. 2, an inner housing 100*b* is disposed inside the outer housing 100*a* and includes the flexible bag 101. The housing 100*b* also includes an ultrasonic sensor 102 that is the oscillator for vibrating the fluid contained in the flexible bag 101. By vibration, it is meant that bag 101 may move up, down and side to side. Housing 100*b* also contains a supporting member 106 which is elastically moved by a buffer spring 103 and on which the flexible bag 101 and the ultrasonic sensor 102 are mounted. The inner housing 100*b* is coupled to a camshaft 104 which is eccentrically rotated by an operating motor 105 and rises according to an eccentric distance when the camshaft 104 rotates. Therefore, when the camshaft 104 rotates, the inner housing 100*b* elevates and the flexible bag 101 moves in proximity to the surfaces of nozzles 210 or contacts surface of the nozzles 210.

Figure 3:
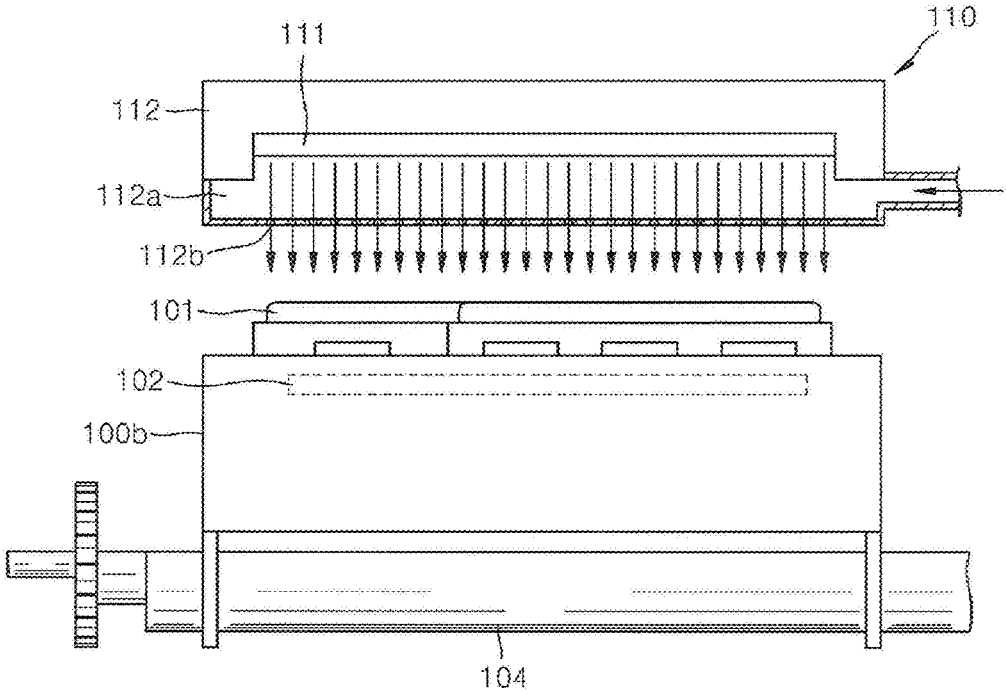
FIGS. 3 and 4 illustrate a process of operating the nozzle cleaning device of FIG. 1.
Figure 4:
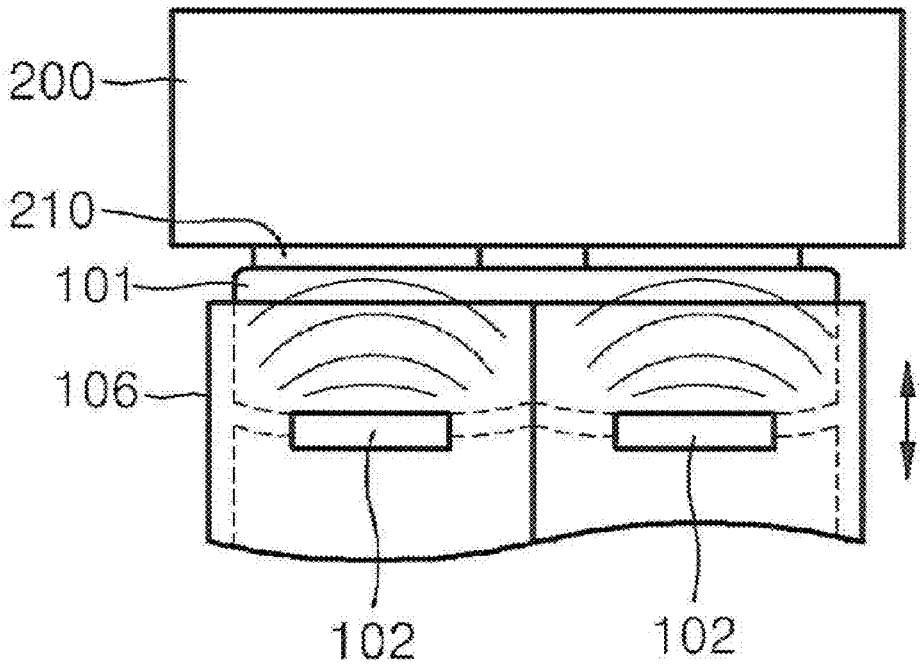

FIGS. 3 and 4 illustrate a process of operating the nozzle cleaning device 100. A flexible bag cleaning unit 110, which cleans a surface of the flexible bag 101 is disposed outside the inkjet head 200 (FIG. 4). Specifically, the flexible bag cleaning unit 110 that may remain after the bag 101 has wiped the outlet hole 211 (FIG. 1) of the nozzles 210 (FIG. 1) with a cleaning solution. As shown in FIG. 3, the flexible bag cleaning unit 110 includes a spray head 112 which sprays the cleaning solution through spray holes 112*b* due to vibrations generated by an ultrasonic sensor 111. That is, like in a humidifier, the cleaning solution contained in a chamber 112*a* is sprayed through the spray holes 112*b* due to the vibration generated by the ultrasonic sensor 111. The cleaning solution removes the ink stains on a surface of the flexible bag 101. The sprayed cleaning solution evaporates together with the ink stains. The reference numeral 120 of FIG. 1 denotes a liquid cleaning composition tank 120 which supplies the cleaning solution to the flexible bag cleaning unit 110.

Hereinafter, a method of cleaning using the nozzle cleaning device 100 will be described in detail with reference to FIGS. 1 through 4. To perform a cleaning process, the outer housing 100*a* (FIG. 1) is moved in such a way that the flexible bag 101 (FIGS. 2 through 4) is disposed in proximity to, for example, directly under a target nozzle of the nozzles 210 to be cleaned. In this regard, the outer housing 100*a* moves along the guide rail 100*d* by rotation of the rotary belt 100*c*. If a shuttle type inkjet head is used, the flexible bag 101 should be disposed above the nozzles 210 to be cleaned with other printers, the bag may be disposed to the side of or at an angle with respect to the nozzle surface.

Then, when cleaning of the target nozzle is to begin, the camshaft 104 is rotated by the operating motor 105 and the inner housing 100*b* rises until the flexible bag 101 is brought into contact with or close to a surface of the target nozzle of the nozzles 210, as illustrated in FIG. 4. The ultrasonic sensor 102 generates vibrations and thus the fluid contained in the flexible bag 101 starts moving and the flexible bag 101 vibrates or otherwise moves. As as a result of the vibration, the flexible bag 101 wipes the outlet hole 211 of the target nozzle of the nozzles 210. In this manner, the cleaning process can be performed without direct contact of the liquid composition with a nozzle. Also, the liquid composition is not spilled and there is no need to supply and collect the liquid composition because the flexible bag 101, which is sealed and filled with the fluid, is used. When the target nozzle is substantially completely cleaned, the rotary belt 100*c* is rotated in such a way that the outer housing 100*a* is positioned to correspond to the next nozzle of the nozzles 210 to be cleaned, and then the rising (or lowering) and vibrating processes are performed again.

When all of the nozzles 210 are completely cleaned, the outer housing 100*a* is moved directly or substantially directly under the flexible bag cleaning unit 110. In this state, when the ultrasonic sensor 111 of the spray head 112 is operated as illustrated in FIG. 3, the cleaning solution contained in the chamber 112*a* is sprayed in a fog-like form to the flexible bag 101 through the spray holes 112*b*. Then, the sprayed cleaning solution is evaporated together with ink stains on the flexible bag 101 and the surface of the flexible bag 101 is cleaned. Thus, the nozzle cleaning process using the flexible bag 101 is completed.

The flexible bag 101 may be any bag that allows external vibrations to be delivered to a fluid contained therein and the motion of the fluid to be delivered to the outside of the bag, such as a plastic bag or a rub bag.

Hereinafter, the disclosure will be described in detail by referring to the examples below. These examples are for illustrative purposes only and are not intended to limit the scope of the disclosure.

Preparation of Liquid Composition for Cleaning Nozzle Surface

Liquid compositions for cleaning a nozzle surface were prepared using the materials listed in Examples 1 to 12 and Comparative Examples 1 to 12 below.

EXAMPLE 1

| | |
|---|---|
| Diethyleneglycol | 10 parts by weight |
| Ethyleneglycol | 5.5 parts by weight |
| NN205 (Compound represented by Formula 5) | 1 part by weight |
| Water (deionized water) | 82.5 parts by weight |

EXAMPLE 2

| | |
|---|---|
| Diethyleneglycol | 10 parts by weight |
| NN207 (Compound represented by Formula 6) | 1 part by weight |
| Surfynol 465 | 1 part by weight |
| Water (deionized water) | 88 parts by weight |

EXAMPLE 3

| | |
|---|---|
| Diethyleneglycol | 10 parts by weight |
| Ethyleneglycol | 3 parts by weight |
| NN210 (Compound represented by Formula 7) | 1 part by weight |
| Surfynol 485 | 0.5 parts by weight |
| Water (deionized water) | 85.5 parts by weight |

EXAMPLE 4

| | |
|---|---|
| Diethyleneglycol | 10 parts by weight |
| 2-pyrrolidone | 2.5 parts by weight |
| Surfynol 465 | 1 part by weight |
| NN207 (Compound represented by Formula 6) | 1 part by weight |
| Water (deionized water) | 85.5 parts by weight |

EXAMPLE 5

| | |
|---|---|
| Diethyleneglycol | 10 parts by weight |
| Ethyleneglycol | 3 parts by weight |
| Ammonium hydroxide | 2.5 parts by weight |
| Surfynol 485 | 0.5 parts by weight |
| NN210 (Compound represented by Formula 7) | 1 part by weight |
| Water (deionized water) | 83 parts by weight |

EXAMPLE 6

| | |
|---|---|
| Diethyleneglycol | 10 parts by weight |
| Ethyleneglycol | 5.5 parts by weight |
| Butyl cabitol | 2.5 parts by weight |
| NN205 (Compound represented by Formula 5) | 1 part by weight |
| Surfynol 465 | 1 part by weight |
| Water (deionized water) | 80 parts by weight |

EXAMPLE 7

| | |
|---|---|
| Diethyleneglycol | 10 parts by weight |
| Urea | 2.5 parts by weight |
| Surfynol 465 | 1 part by weight |
| NN207 (Compound represented by Formula 6) | 1 part by weight |
| Water (deionized water) | 85.5 parts by weight |

EXAMPLE 8

| | |
|---|---|
| Diethyleneglycol | 10 parts by weight |
| Ethyleneglycol | 3 parts by weight |
| E-caprolactam | 2.5 parts by weight |
| Surfynol 485 | 0.5 parts by weight |
| NN210 (Compound represented by Formula 7) | 1 part by weight |
| Water (deionized water) | 83 parts by weight |

EXAMPLE 9

| | |
|---|---|
| Diethyleneglycol | 10 parts by weight |
| Ethyleneglycol | 5.5 parts by weight |
| Ethylene carbonate | 2.5 parts by weight |
| NN205 (Compound represented by Formula 5) | 1 part by weight |
| Surfynol 465 | 1 part by weight |
| Water (deionized water) | 80 parts by weight |

EXAMPLE 10

| | |
|---|---|
| Diethyleneglycol | 10 parts by weight |
| Benzyl alcohol | 2.5 parts by weight |
| Surfynol 465 | 1 part by weight |
| NN207 (Compound represented by Formula 6) | 1 part by weight |
| water (deionized water) | 85.5 parts by weight |

EXAMPLE 11

| | |
|---|---|
| Diethyleneglycol | 10 parts by weight |
| Ethyleneglycol | 3 parts by weight |
| Cycrohexanone | 2.5 parts by weight |
| NN210 (Compound represented by Formula 7) | 1 part by weight |
| Water (deionized water) | 83.5 parts by weight |

EXAMPLE 12

| | |
|---|---|
| Diethyleneglycol | 10 parts by weight |
| Ethyleneglycol | 3 parts by weight |
| Dibutylphthalate | 2.5 parts by weight |
| Surfynol 485 | 0.5 parts by weight |
| NN210 (Compound represented by Formula 7) | 1 part by weight |
| Water (deionized water) | 83 parts by weight |

COMPARATIVE EXAMPLE 1

| | |
|---|---|
| Diethyleneglycol | 10 parts by weight |
| Surfynol 465 | 1 part by weight |
| Water (deionized water) | 89 parts by weight |

COMPARATIVE EXAMPLE 2

| | |
|---|---|
| Diethyleneglycol | 10 parts by weight |
| Ethyleneglycol | 3 parts by weight |
| Surfynol 485 | 0.5 parts by weight |
| Water (deionized water) | 86.5 parts by weight |

COMPARATIVE EXAMPLE 3

| | |
|---|---|
| Diethyleneglycol | 10 parts by weight |
| Ethyleneglycol | 5.5 parts by weight |
| Surfynol 465 | 1 part by weight |
| Water (deionized water) | 83.5 parts by weight |

COMPARATIVE EXAMPLE 4

| | |
|---|---|
| Diethyleneglycol | 10 parts by weight |
| Surfynol 465 | 1 part by weight |
| Water (deionized water) | 85.5 parts by weight |

COMPARATIVE EXAMPLE 5

| | |
|---|---|
| Diethyleneglycol | 10 parts by weight |
| Ethyleneglycol | 3 parts by weight |
| Surfynol 485 | 0.5 parts by weight |
| Water (deionized water) | 83 parts by weight |

COMPARATIVE EXAMPLE 6

| | |
|---|---|
| Diethyleneglycol | 10 parts by weight |
| Ethyleneglycol | 5.5 parts by weight |
| Surfynol 465 | 1 part by weight |
| Water (deionized water) | 80 parts by weight |

COMPARATIVE EXAMPLE 7

| | |
|---|---|
| Diethyleneglycol | 10 parts by weight |
| Surfynol 485 | 1 part by weight |
| Water (deionized water) | 85.5 parts by weight |

COMPARATIVE EXAMPLE 8

| | |
|---|---|
| Diethyleneglycol | 10 parts by weight |
| Ethyleneglycol | 3 parts by weight |
| Water (deionized water) | 83.5 parts by weight |

COMPARATIVE EXAMPLE 9

| | |
|---|---|
| Diethyleneglycol | 10 parts by weight |
| Ethyleneglycol | 5.5 parts by weight |
| Surfynol 485 | 1 part by weight |
| Water (deionized water) | 80 parts by weight |

COMPARATIVE EXAMPLE 10

| | |
|---|---|
| Diethyleneglycol | 10 parts by weight |
| Ethyleneglycol | 3 parts by weight |
| Surfynol 465 | 0.5 parts by weight |
| Water (deionized water) | 83 parts by weight |

COMPARATIVE EXAMPLE 11

| | |
|---|---|
| Diethyleneglycol | 10 parts by weight |
| Surfynol 485 | 1 part by weight |
| Water (deionized water) | 89 parts by weight |

COMPARATIVE EXAMPLE 12

| | |
|---|---|
| Diethyleneglycol | 10 parts by weight |
| Ethyleneglycol | 3 parts by weight |
| Surfynol 465 | 0.5 parts by weight |
| Water (deionized water) | 86.5 parts by weight |

EXPERIMENTAL EXAMPLE 1

Missing Nozzle Test

Each of the liquid compositions prepared according to Examples 1 to 12 and Comparative Examples 1 to 12 and distilled water were used in an inkjet printer having a blade. The amounts of the liquid composition and the distilled water were the same. Before the test, a nozzle surface had been coated with a magenta ink and dried for 2 days. The degree of cleaning was measured using a missing nozzle detecting pattern, specifically, by counting the number of nozzles that failed to eject ink. The total number of nozzles was 760, and the number of missing nozzle patterns and the degree of ink remaining on the nozzles were measured. The results are shown in Table 1 below.

Assessment references: 'A' denotes the number of missing nozzles.

◎: A<10

O: 10≦A<50

X: 50≦A<100

XX: 100≦A

EXPERIMENTAL EXAMPLE 2

Observation of Nozzle Surface

Each of the liquid compositions prepared according to Examples 1 to 12 and Comparative Examples 1 to 12 and distilled water were used in an inkjet printer having a blade. The amounts of the liquid composition and the distilled water were the same. Before the test, a nozzle surface had been coated with a magenta ink and dried for 2 days.

The nozzle surface was wiped once and observed. The observation results are shown in Table 1 below. 'A' denotes a case in which an ink stain was substantially not present on the nozzle surface. 'B' denotes a case in which a slight ink stain was present on the nozzle surface. 'C' denotes a case in which an ink stain was substantially present on the nozzle surface in a measurable amount. The results are shown in Table 1 below.

EXPERIMENTAL EXAMPLE 3

Nozzle Clogging Test

Each of the liquid compositions prepared according to Examples 1 to 12 and Comparative Examples 1 to 12 and distilled water were used in an inkjet printer having a blade. The amounts of the liquid composition and the distilled water were the same. Cartridges were filled with cyan ink, yellow ink, magenta ink, and black ink. The filled cartridges were uncapped and left to sit for one week. Then, a maintenance process was performed on the uncapped cartridges using a wet blade function. 25% solid patterns were then printed using the resultant cartridges.

The one-week uncapped cartridges were installed in an inkjet printer and then a 25% solid pattern was printed. The results are shown in Table 1 below. Referring to Table 1, 'A' denotes a case in which when the 25% solid pattern was printed, nozzles were recovered within 100 dots. 'B' denotes a case in which when the 25% solid pattern was printed, nozzles were recovered within an A4 sheet. 'C' denotes a case in which when the 25% solid pattern was printed. At least one nozzle was not recovered within an A4 sheet.

TABLE 1

| | Number of missing nozzle patterns (the total number of nozzles is 760) | State of nozzle surface | Nozzle clogging test | | | |
|---|---|---|---|---|---|---|
| | | | Cyan | Yellow | Magenta | Black |
| Example 1 | ◎ | A | A | A | A | B |
| Example 2 | ◎ | B | B | A | A | B |

TABLE 1-continued

| | Number of missing nozzle patterns (the total number of nozzles is 760) | State of nozzle surface | Nozzle clogging test | | | |
|---|---|---|---|---|---|---|
| | | | Cyan | Yellow | Magenta | Black |
| Example 3 | ◎ | A | A | A | B | B |
| Example 4 | ◎ | A | A | A | A | A |
| Example 5 | ◎ | A | A | A | A | A |
| Example 6 | ◎ | A | A | A | A | A |
| Example 7 | ◎ | A | A | A | A | A |
| Example 8 | ◎ | B | A | A | A | A |
| Example 9 | ◎ | A | A | A | A | B |
| Example 10 | ◎ | A | A | A | A | A |
| Example 11 | ◎ | A | A | A | A | A |
| Example 12 | ◎ | A | A | A | A | A |
| Distilled water | XX | C | C | B | C | C |
| Comparative Example 1 | X | C | C | B | C | C |
| Comparative Example 2 | X | C | C | B | C | C |
| Comparative Example 3 | X | C | C | B | B | C |
| Comparative Example 4 | X | C | C | B | C | C |
| Comparative Example 5 | X | C | C | B | C | C |
| Comparative Example 6 | X | C | B | B | C | C |
| Comparative Example 7 | X | C | B | C | C | B |
| Comparative Example 8 | X | C | C | B | C | B |
| Comparative Example 9 | X | C | C | C | B | B |
| Comparative Example 10 | X | C | C | C | B | C |
| Comparative Example 11 | X | C | C | C | C | C |
| Comparative Example 12 | X | C | C | B | C | C |

As shown in Table 1, when distilled water and the liquid compositions prepared according to Comparative Examples 1 to 12 were used, an ink stain was not substantially completely removed from a nozzle surface and many nozzle patterns were not formed. Moreover, in the one-week uncapped clogging test, distilled water and the liquid compositions prepared according to Comparative Examples 1 to 12 showed excellent recovery characteristics when nozzles were wet-wiped. Specifically, when distilled water was used as a liquid composition, many stains remained on the nozzle surface and a substantially large number of nozzle patterns were formed.

However, when the liquid compositions prepared according to Examples 1 to 12 were used, almost no ink was present on the nozzle surface, and missing nozzle patterns were not formed. Moreover, in the one-week uncapped clogging test, the liquid compositions prepared according to Examples 1 to 12 exhibited excellent recovery characteristics when nozzles were wet-wiped.

That is, it can be seen that when the liquid compositions for cleaning a nozzle surface prepared according to Examples 1 to 3, each including a solvent and polyoxyethyleneglycol-based compound, impurities formed on a nozzle surface of a printer head are effectively removed. Also, with regard to the liquid compositions for cleaning a nozzle surface prepared according to Examples 4 to 12, a stabilizer that separates impurities from the nozzle surface is used together with the polyoxyethyleneglycol-based compound that separates impurities from the nozzle surface and prevents re-attachment of the once-separated impurities. The combination leads to a synergy effect for cleaning the nozzle surface.

While the disclosure has been particularly shown and described with reference to respective examples thereof, it will be understood by those of ordinary skill in the art that various changes in form and details may be made therein without departing from the spirit and scope of the disclosure as defined by the following claims.

What is claimed is:

1. A liquid composition for cleaning a nozzle surface, the composition comprising:

a solvent; and a polyoxyethyleneglycol-based compound, wherein the amount of the polyoxyethyleneglycol-based compound is about 0.1 to about 20 parts by weight based on 100 parts by weight of the solvent, wherein the polyoxyethyleneglycol-based compound is represented by Formula 1:

<Formula 1>

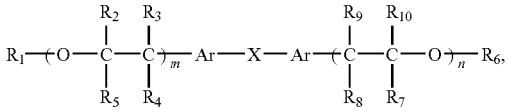

wherein X is a connecting group, O, S, C═O, or a substituted or unsubstituted C1-C20 alkylene group, wherein Ar is a C6-C30 substituted or unsubstituted arylene group, or a C2-C30 substituted or unsubstituted heteroarylene group, wherein R1, R2, R3, R4, R5, R6, R7, R8, R9 and R10 are each independently, hydrogen, halogen, a carboxylic group, a cyano group, an amino group, a substituted or unsubstituted C1-C20 alkyl group, a substituted or unsubstituted C1-20 alkoxy group, a substituted or unsubstituted C2-20 alkenyl group, a substituted or unsubstituted C2-20 alkynyl group, a substituted or unsubstituted C1-20 heteroalkyl group, a substituted or unsubstituted C6-C30 aryl group, or a substituted or unsubstituted C4-30 heteroaryl group, wherein m and n are each independently an integer in the range of 1 to 10, and wherein a viscosity of the liquid composition is equal to or less than a viscosity of ink of the nozzle surface.

2. The liquid composition of claim 1, wherein the polyoxyethyleneglycol-based compound is represented by Formula 2:

<Formula 2>

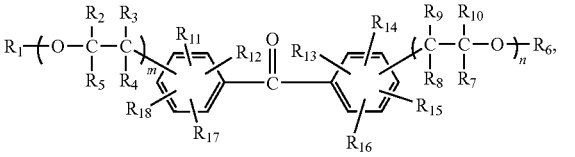

wherein R1, R2, R3, R4, R5, R6, R7, R8, R9, R10, R11, R12, R13, R14, R15, R16, R17 and R18 are each independently, hydrogen, halogen, a carboxylic group, a cyano group, an amino group, a substituted or unsubstituted C1-C20 alkyl group, a substituted or unsubstituted C1-20 alkoxy group, a substituted or unsubstituted C2-20 alkenyl group, a substituted or unsubstituted C2-20 alkynyl group, a substituted or unsubstituted C1-20 heteroalkyl group, a substituted or unsubstituted C6-C30 aryl group, or a substituted or unsubstituted C4-30 heteroaryl group; and wherein m and n are each independently an integer in the range of 1 to 10.

3. The liquid composition of claim 1, wherein the polyoxyethyleneglycol-based compound is represented by Formula 3 or Formula 4:

<Formula 3>

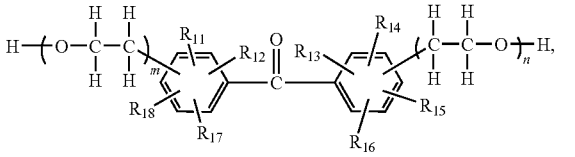

<Formula 4>

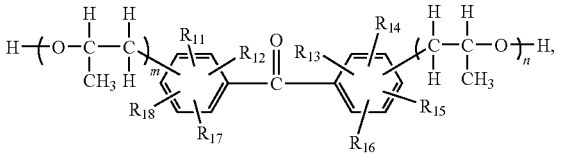

wherein R11, R12, R13, R14, R15, R16, R17 and R18 are each independently, hydrogen, halogen, a carboxylic group, a cyano group, an amino group, a substituted or unsubstituted C1-C20 alkyl group, a substituted or unsubstituted C1-20 alkoxy group, a substituted or unsubstituted C2-20 alkenyl group, a substituted or unsubstituted C2-20 alkynyl group, a substituted or unsubstituted C1-20 heteroalkyl group, a substituted or unsubstituted C6-C30 aryl group, or a substituted or unsubstituted C4-30 heteroaryl group; and wherein m and n are each independently an integer in the range of 1 to 10.

4. The liquid composition of claim 1, wherein the polyoxyethyleneglycol-based compound is selected from the group consisting of Formulas 5 through 7:

<Formula 5>

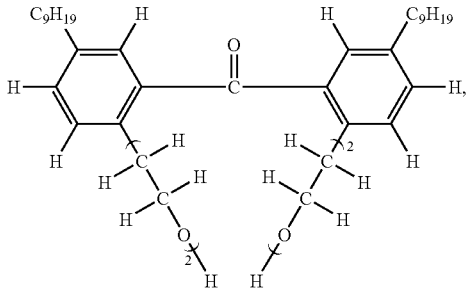

<Formula 6>

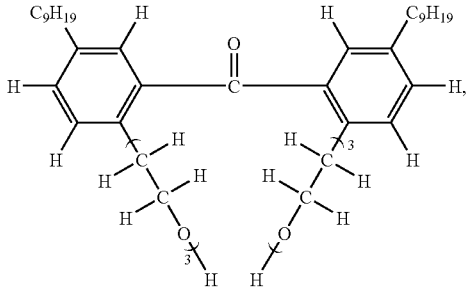

<Formula 7>

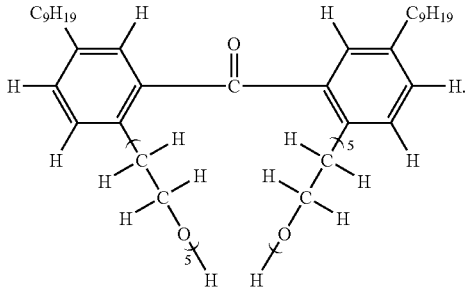

5. The liquid composition of claim 1, further comprising a stabilizer.

6. The liquid composition of claim 1, wherein the pH of the liquid composition is in a range of about 6 to about 10.

7. The liquid composition of claim 1, wherein the viscosity of the liquid composition is in a range of about 1.5 cps to about 20 cps.

8. The liquid composition of claim 1, wherein the solvent is selected from the group consisting of a water-based solvent, an organic solvent and a mixture thereof.

9. The liquid composition of claim 1, wherein the surface tension of the liquid composition is in a range of about 15 dyne/cm to about 73 dyne/cm at a temperature of 20° C.

10. The liquid composition of claim 5, wherein the amount of the stabilizer is in a range of about 0.01 to about 20 parts by weight based on 100 parts by weight of the solvent.

11. The liquid composition of claim 5, wherein the stabilizer comprises at least one compound selected from the group consisting of a cyclic amide-based compound, an ammonium-based compound, an alcohol-based compound, a ketone-based compound, a cyclic carbonate-based compound and a phthalate-based compound.

12. The liquid composition of claim 5, wherein the stabilizer comprises at least one compound selected from the group consisting of 2-pyrrolidone, 1-methyl-2-pyrrolidone, N-(2-hydroxyethyl)-2-pyrrolidone, ammonium hydroxide, diethyleneglycolbutylether, urea, e-caprolactam, ethylene carbonate, benzyl alcohol, cyclohexanone and dibutylphthalate.

13. The liquid composition of claim 8, wherein the amount of the organic solvent is in a range of about 0.1 to about 130 parts by weight based on 100 parts by weight of the water-based solvent.

14. The liquid composition of claim 8, wherein the organic solvent comprises at least one solvent selected from the group consisting of a monovalent alcohol-based solvent, a polyhydric alcohol-based solvent, a ketone-based solvent, an ester-based solvent, a nitrogen-containing solvent and a sulfur-containing solvent.

15. The liquid composition of claim 1, further comprising at least one kind of additive selected from a group consisting of a wetting agent, a dispersing agent, a surfactant, a viscosity controller, a pH controller, and an antioxidant.

* * * * *

UNITED STATES PATENT AND TRADEMARK OFFICE

CERTIFICATE OF CORRECTION

PATENT NO. : 8,129,321 B2
APPLICATION NO. : 12/543140
DATED : March 6, 2012
INVENTOR(S) : Ho-Ryul Lee et al.

It is certified that error appears in the above-identified patent and that said Letters Patent is hereby corrected as shown below:

On the Title page, Section (54): "Liquid Compostion for Cleaning a Nozzle Surface, Method of Cleaning a Nozzle Surface Using the Liquid Composition, and Inkjet Recording Apparatus including the Liquid Composition" should be changed to "Liquid Composition for Cleaning a Nozzle Surface, Method of Cleaning a Nozzle Surface Using the Liquid Composition, and Inkjet Recording Apparatus including the Liquid Composition"

Signed and Sealed this
Tenth Day of July, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,129,321 B2
APPLICATION NO. : 12/543140
DATED : March 6, 2012
INVENTOR(S) : Ho-Ryul Lee et al.

It is certified that error appears in the above-identified patent and that said Letters Patent is hereby corrected as shown below:

On the Title page, Section (54) and at Column 1, lines 1-6, Title: "Liquid Compostion for Cleaning a Nozzle Surface, Method of Cleaning a Nozzle Surface Using the Liquid Composition, and Inkjet Recording Apparatus including the Liquid Composition" should be changed to "Liquid Composition for Cleaning a Nozzle Surface, Method of Cleaning a Nozzle Surface Using the Liquid Composition, and Inkjet Recording Apparatus including the Liquid Composition"

This certificate supersedes the Certificate of Correction issued July 10, 2012.

Signed and Sealed this
Fourteenth Day of August, 2012

David J. Kappos

David J. Kappos
*Director of the United States Patent and Trademark Office*